US005388845A

United States Patent [19]

Soo

[11] Patent Number: 5,388,845

[45] Date of Patent: Feb. 14, 1995

[54] BLADE ASSEMBLY FOR AN ICE SKATE

[76] Inventor: Mike Soo, No. 403, Chung Shan Rd., Jen Teh Hsiang, Tainan Hsien, Taiwan, Prov. of China

[21] Appl. No.: 118,031

[22] Filed: Sep. 8, 1993

[51] Int. Cl.[6] ..... A63C 1/38

[52] U.S. Cl. ..... 280/11.17

[58] Field of Search ..... 280/841, 11.14, 11.15, 280/11.17, 11.18, 11.27, 11.12

[56] References Cited

U.S. PATENT DOCUMENTS

| | | | |
|---|---|---|---|
| 612,028 | 10/1898 | Fisher | 280/11.17 |
| 1,904,270 | 4/1933 | Charette | 280/11.17 |
| 1,911,148 | 5/1933 | Dunne | 280/11.17 |
| 2,520,548 | 8/1950 | Jack | 280/11.17 |
| 3,026,119 | 3/1962 | Bauer | 280/11.17 X |

*Primary Examiner*—Richard M. Camby

*Assistant Examiner*—Michael Mar

*Attorney, Agent, or Firm*—Ralph F. Crandell

[57] ABSTRACT

An ice blade assembly includes a hollow base frame including an upper wall with two sides, a side wall extending downward from each side of the upper wall, and a pair of spaced retaining ribs projecting downward from an underside of the upper wall and extending toward each other, defining a space therebetween. Each side wall includes an upper section and a lower section, the upper sections being dimensioned to be securely received in a space defined by two parallel mounting ribs extending from an underside of an upper structure of a skate, the lower sections defining a passage in alignment with the space. An ice blade passes through the passage, with an upper edge thereof securely mounted between the retaining ribs and with a mediate section thereof retained between the passage.

4 Claims, 3 Drawing Sheets

BLADE ASSEMBLY FOR AN ICE SKATE

BACKGROUND OF THE INVENTION

1. Field of the Invention

The present invention relates to an improved ice blade assembly for ice skates.

2. Description of Related Art

Skates have existed for more than one hundred years. Various structures have been developed to mitigate and/or obviate all kinds of problems encountered during use. For example, undercarriage structures have been proposed to mount either rollers or an ice blade, which is quite convenient for users. It is, however, found that mounting and/or detaching the ice blade is still time-consuming. The present invention intends to provide an improved ice blade assembly to solve this problem.

SUMMARY OF THE INVENTION

An ice blade assembly provided by the present invention includes a hollow base frame and an ice blade securely attached to the hollow base frame. The hollow base frame includes an upper wall, a side wall extending downward from each of two sides of the upper wall and along the longitudinal direction of the upper structure of a skate to which the ice blade assembly is being attached. Each side wall includes an upper section and a lower section. The upper sections are dimensioned so as to be securely received between a pair of mounting ribs extending downward from an underside of the upper structure. The lower sections define a passage through which an ice blade passes. A pair of spaced retaining ribs project downward from an underside of the upper wall and extend toward each other, defining a space therebetween for retaining an ice blade therein. The passage defined by the lower sections aligns with the space between the retaining ribs. A pair of first elongate holes are formed in upper section of each of front and rear ends of the ice blade. Below the first elongate holes, a pair of second elongate holes are formed in front section of the ice blade, while an elongate hole and a round hole are formed in the rear section of the ice blade. Corresponding holes are formed in front and rear ends of the upper and lower sections of the side walls.

By such an arrangement, only bolts and nuts are required, with associated holes aligning with each other, to secure the ice blade assembly in position.

Other objects, advantages, and novel features of the invention will become more apparent from the following detailed description when taken in conjunction with the accompanying drawings.

DESCRIPTION OF THE PREFERRED EMBODIMENTS

Figure 1:
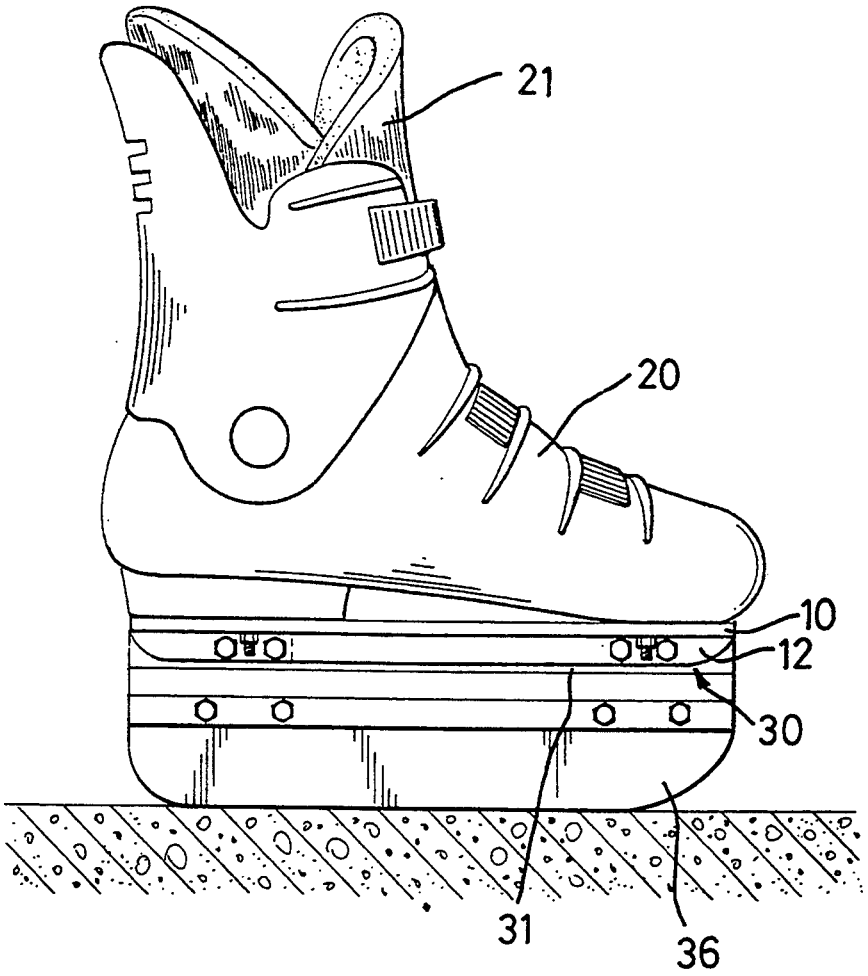
FIG. 1 is a perspective view of a skate with an ice blade assembly in accordance with the present invention.
Figure 2:
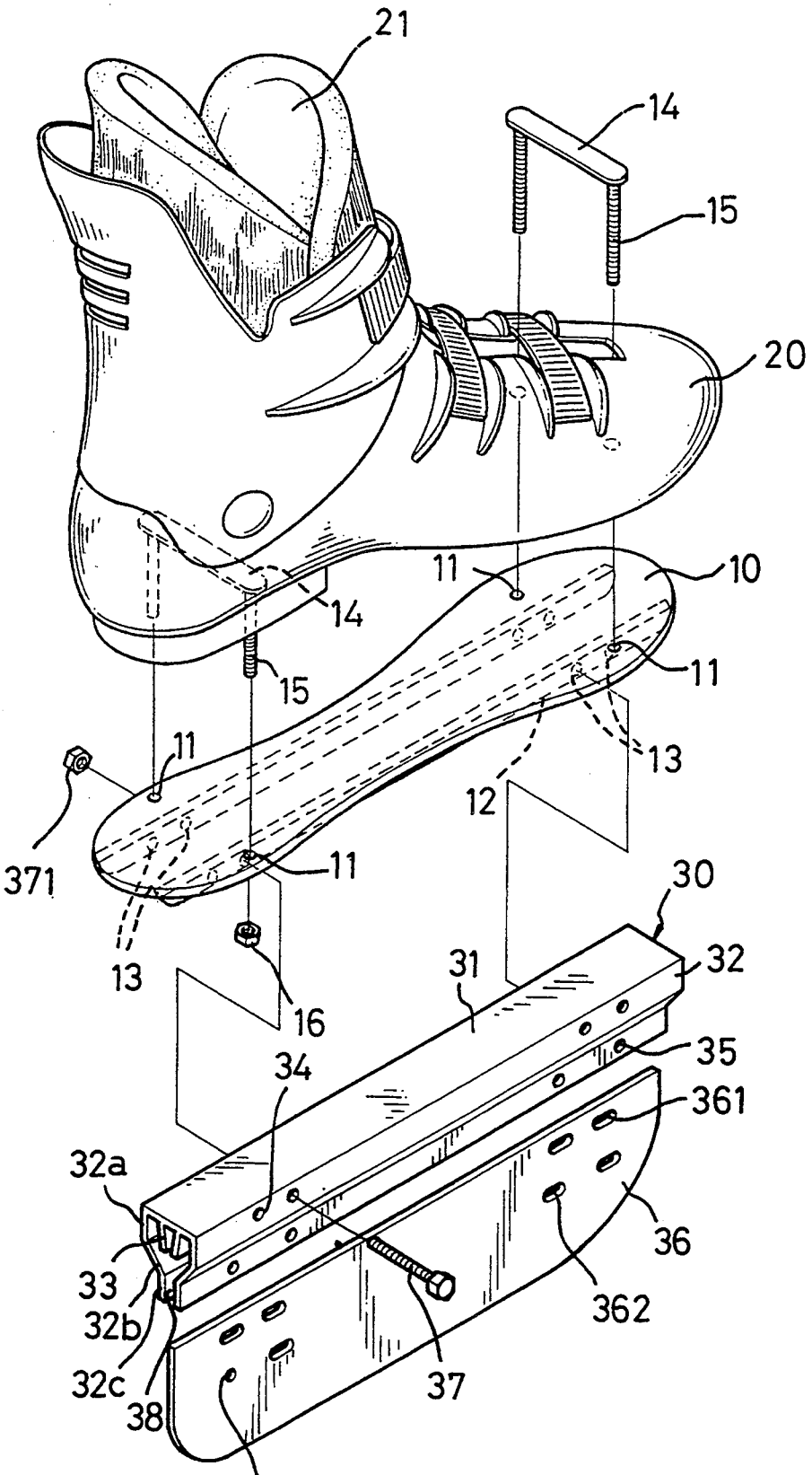
FIG. 2 is an exploded view of the ice skate in FIG. 1.
Figure 3:
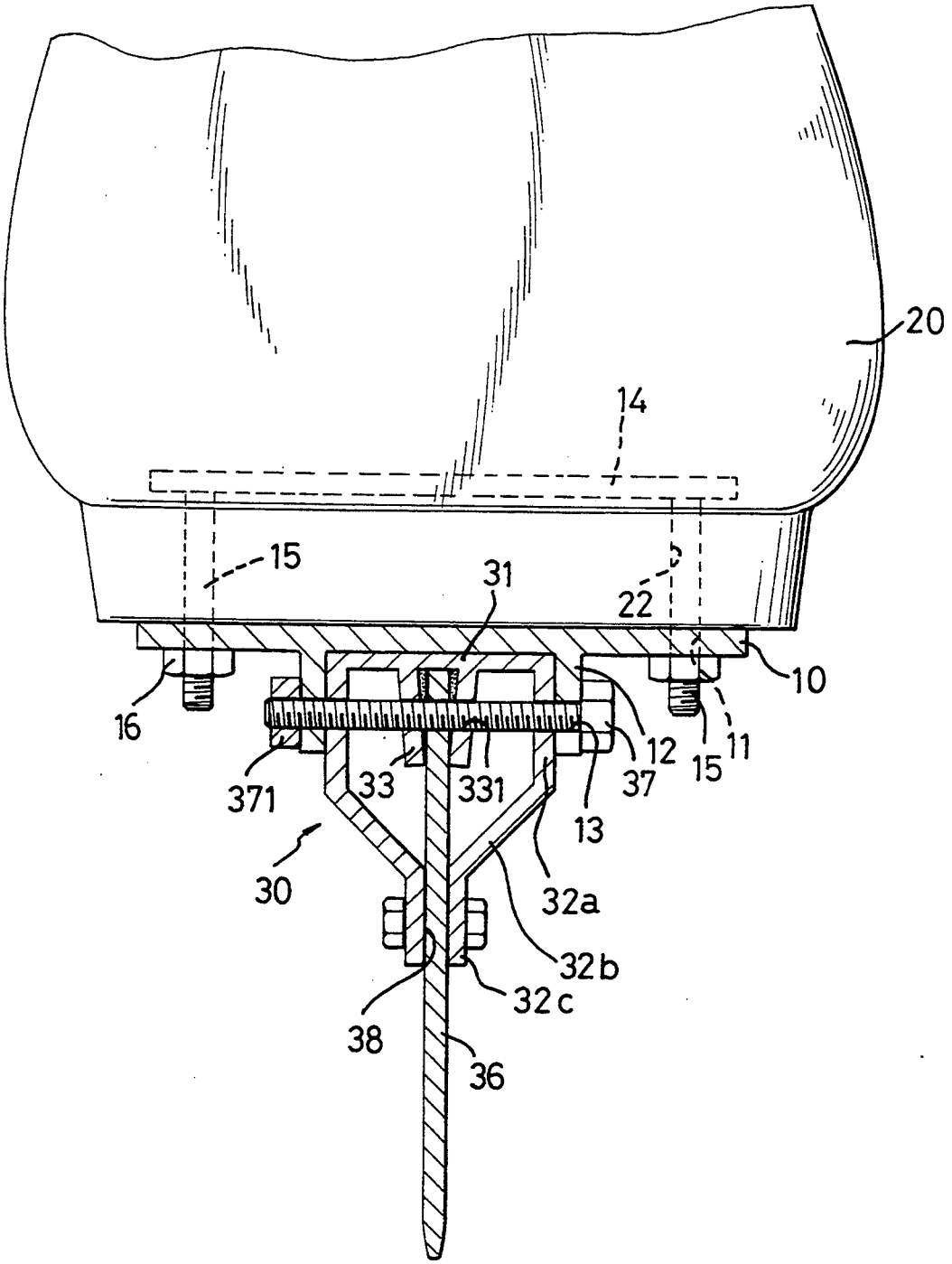
FIG. 3 is a rear view, at an enlarged scale and partly sectioned, showing,the engagement between the undercarriage and the ice blade assembly of the ice skate.

Referring to FIGS. 1 through 3, an ice skate generally includes an upper structure (such as a skate boot 20), an ice blade assembly 30, and means for mounting the ice blade assembly 30 to an underside of the skate boot 20.

In this embodiment, the mounting means includes a plate 10 having a configuration substantially conforming with the bottom of a skate boot 20 and having two pairs of holes 11 respectively formed in front and rear sections thereof. Two parallel mounting ribs 12 project downward from an underside of the plate 10 and extend along the longitudinal direction of the plate 10. A pair of transverse holes 13 are formed in each of front and rear sections of each mounting rib 12.

Referring to FIG. 3, the plate 10 is removably attached to the underside of the skate boot 20 by a pair of mounting strips 14 each of which has a pair of studs 15 extending outward from one side thereof. The mounting strips 14 are mounted inside the skate boot 20 before the lining 21 of the boot 20 is installed, with the studs 15 passing through holes 22 in the skate boot 20 and further through holes 11 in the plate 10, the mounting strips 14 are then fastened by nuts 16.

The ice blade assembly includes a hollow base frame 30 and an ice blade 36 securely attached to the hollow base frame 30. The hollow base frame 30 includes an upper wall 31, a side wall 32 extending downward from each of two sides of the upper wall 31 and along the longitudinal direction of the plate 10 and including an upper section **32*a*, a transition section 32*b*, and a lower section 32*c*. The upper sections 32*a* are dimensioned so as to be securely received between the mounting ribs 12. The lower sections 32c define a passage 38 through which an ice blade 36 passes. A pair of spaced retaining ribs 33 project downward from an underside of the upper wall 31 and extend toward each other, defining a space therebetween for retaining the ice blade 36 therein. The passage 38 defined by the lower sections 32*c* aligns with the space between the retaining ribs 33. A pair of first elongate holes 361 are formed in upper section of each of front and rear ends of the ice blade 36. Below the first elongate holes 361, a pair of second elongate holes 362 are formed in front section of the ice blade 36, while an elongate hole 362 and a round hole 363 are formed in the rear section of the ice blade 36. Corresponding holes 34 and 35 are formed in front and rear ends of the upper and lower sections 32*a* and 32*c* of the side walls 32**.

In this embodiment, the upper edge of the ice blade 36 is secured between the retaining ribs 33, such as by gluing, with hole 361 aligning with holes 331 in the retaining ribs 33 and with holes 362 and 363 aligning with holes 35. Four bolts 37 pass through associated aligned holes 13, 34, 361, and 331 and nuts 371 are provided to secure the ice blade 36 as well as the hollow base frame 30. Further bolts and nuts (not labeled) are provided to the lower sections **32*c* to further fasten the ice blade 36. It is appreciated that, during assembling, the user may first align the leftmost hole 363 in the ice blade 36 with the leftmost hole 35 in the lower sections 32*c*. The remaining elongate holes allow for slight deformation of the ice blade 36 and the hollow base frame 30** which might occur during manufacturing.

The users may assemble or detach the ice blade assembly with ease as only four bolts and four nuts are involved.

Although the invention has been explained in relation to its preferred embodiment, it is to be understood that many other possible modifications and variations can be made without departing from the spirit and scope of the invention as hereinafter claimed.

I claim:

1. An ice blade assembly for being attached to a pair of parallel mounting ribs at an underside of a skate, said ice blade assembly comprising:

a hollow base frame including an upper wall with two sides, a side wall extending downward from each said side of said upper wall and along a longitudinal direction of said mounting ribs, and a pair of spaced retaining ribs projecting downwardly from an underside of said upper wall, inwardly spaced from said side walls, and extending toward each other to define a space therebetween, each said side wall including an upper section and a lower section, said upper sections being dimensioned to be securely received between said mounting ribs, said lower sections converging toward each other to define a passage therebetween in alignment with said space defined by said retaining ribs; and an ice blade passing through said passage, with an upper edge thereof securely mounted between said retaining ribs and with a mediate section thereof retained between said passage.

2. The ice blade assembly as claimed in claim 1 wherein a first transverse hole means is formed in said retaining ribs and said upper sections of said hollow base frame, a second transverse hole means is formed in said lower sections of said hollow base frame, a third transverse hole means is formed in said upper edge of said ice blade and is in alignment with said first transverse hole means, and a fourth transverse hole means is formed in said mediate section of said ice blade and is in alignment with said second hole means.

3. The ice blade assembly as claimed in claim 2 wherein said third transverse hole means includes a plurality of elongate holes.

4. The ice blade assembly as claimed in claim 3 wherein said fourth transverse hole means includes a round hole and a plurality of elongate holes.

* * * * *